United States Patent [19]

Bonneson et al.

[11] 4,216,870

[45] Aug. 12, 1980

[54] CRANE MOUNTING

[75] Inventors: Garland W. Bonneson, Brookfield; Kenneth V. Johnson, Oconomowoc, both of Wis.

[73] Assignee: Bucyrus-Erie Company, South Milwaukee, Wis.

[21] Appl. No.: 909,238

[22] Filed: May 24, 1978

[51] Int. Cl.[2] ..... B66C 23/62; B66C 23/84

[52] U.S. Cl. ..... 212/223; 104/35; 104/46; 212/253

[58] Field of Search ..... 212/66–70, 212/3 A, 3 R; 104/35, 46, 248

[56] References Cited

U.S. PATENT DOCUMENTS

| | | | |
|---|---|---|---|
| 1,352,575 | 9/1920 | Bingaman | 212/70 X |
| 1,765,967 | 6/1930 | Clutter et al. | 212/69 X |
| 1,929,397 | 10/1933 | Davidson | 212/70 X |
| 2,408,378 | 10/1946 | Davenport et al. | 212/70 |
| 4,011,955 | 3/1977 | Morrow, Sr. et al. | 212/70 X |

FOREIGN PATENT DOCUMENTS

| | | | |
|---|---|---|---|
| 1470019 | 4/1977 | United Kingdom | 212/3 R |

*Primary Examiner*—Stephen G. Kunin
*Assistant Examiner*—Edmond G. Rishell, Jr.
*Attorney, Agent, or Firm*—Quarles & Brady

[57] ABSTRACT

A marine crane having an upper works rotatably mounted on a pedestal adapter, includes a retainer for limiting the extent to which the upper works can be tilted, such retainer having an arcuate member secured to the upper works that extends partially around the pedestal adapter and presents a lip beneath and out of contact with a stationary circumferential member forming a part of the pedestal adapter. The arcuate member has a series of vertical, plate-like buttresses spaced along its circumferential length that have outer ends facing a machinery deck of the upper works to brace the arcuate member, so as to retain the arcuate member in place in the event of abnormal forces being applied thereto.

7 Claims, 3 Drawing Figures

CRANE MOUNTING

BACKGROUND OF THE INVENTION

This invention relates to mountings for cranes, and more particularly, to a retainer which limits the separation of the upper works of a crane from its base during the occurrence of an abnormal condition. This retainer may find particular application in use on marine crane mountings.

With the development in recent years of offshore oil drilling platforms anchored at sea, specialized luffing cranes have been installed on such platforms for handling loads both on the platforms and between the platforms and ships brought alongside. Such cranes are commonly called marine cranes and the revolving upper works of a conventional marine crane is supported on a swing circle mounted atop a pedestal fixed to the platform. Instances have recently occurred where such cranes while lifting and transferring cargo between a ship and a platform have been subjected to unusually large, dynamic loads peculiar to the nature of their use. For example, if cargo aboard a ship is hooked to a crane while the ship is in a turbulent or heavy sea, a dynamic load may be imposed on the crane by the action of the ship falling away from the platform, or by a vertical rise and fall of the ship in response to passing crests and troughs of the waves. The roll and pitch of the ship may also impose extreme dynamic load variations, particularly when the crane hoist line is caused to slacken and tighten in response to ship movement while the load is not fully airborne or free of the ship. The cargo then presents a rapidly varying load on the crane that may impose unusually large peak stresses. Severe and unpredictable load stresses can also develop from cargo catching on ship rails, hatches or other protrusions of a ship superstructure.

These various dynamic load variations can be accentuated when crane operators and other personnel use the equipment under conditions which require greater caution than that exercised. An operator may, for example, lower the boom tip to stay over a load moving outward from the crane as a ship falls away, and thus increase the boom radial distance beyond the rated capability of the equipment for the particular load, or conversely, he may allow the load to become improperly positioned with a shift of the ship, and then commence lifting under improper conditions. In the exigencies of such situations, these maneuvers of an operator may be carried out without properly checking the relation of the load to the crane rating, and parts may be stressed beyond limits for which the crane is designed. It also appears that at times an operator may simply overload his crane beyond its designed capacity to load or unload a cargo as quickly as possible.

The unpredictable, dynamic loads that lead to overloading of marine cranes, as contrasted to the basically static and pure lifting loads of land cranes, makes it desirable to have an arrangement that reduces the possibility of total separation of a crane upper works from its pedestal. This would minimize possible injury to personnel, loss of the crane and other property damage.

The prior art has disclosed a crane modification to counteract the effects of excessive loading of marine cranes in U.S. Pat. No. 4,011,955 issued Mar. 15, 1977, to Morrow Sr. et al for a "Sea Crane Tiedown." There, an annular collar is attached to a pedestal, and a ring-like device positioned beneath the collar is suspended by tension links depending from the frame of the crane upper works. This ring-like device is out of contact with both the collar and pedestal, and the entire structure is referred to as a "sea crane tiedown." Such structure is bulky and complex, and difficult to install. British Pat. No. 1,470,019 for an "Offshore Counterbalancing Crane" discloses hook rollers that are mounted on a bracket for rotating along the underside of a flange of a combination bull gear and roller path. This, however, is not for the purpose of providing retention of the upper works in case of an overload that could topple the upper works from the crane base.

Arrangements that limit the separation of an upper works from its supporting structure have also been provided for other types of material handling machines. One such device is disclosed in U.S. Pat. No. 1,929,397 issued Oct. 3, 1933, to Davidson for an "Excavating Apparatus." Davidson discloses radial lugs that extend under a projection along the circumference of an annular track. Another device is disclosed in U.S. Pat. No. 2,408,378 issued Oct. 1, 1946, to Davenport for a "Stabilizer Attachment For Cranes." Davenport shows a plurality of roller-carrying hangers that ride along an annular track during operation of the crane. None of these arrangements are entirely satisfactory, however, and the present arrangement has been developed to provide an improved means for limiting the separation of the upper works of a crane from its supporting structure during the occurrence of an abnormal condition.

SUMMARY OF THE INVENTION

The present invention relates to a crane mounting that reduces the possibility of a separation of a crane upper works from its base, and it more specifically resides in a hook-like member carried by the rotatable upper works that extends beneath and out of contact with a stationary circumferential member on the base together with a series of buttresses secured to the hook-like member. These buttresses provide additional support for the hook-like member when such members strike the stationary member to resist separation of the upper works from the base, as may occur under an abnormal load condition tending to separate the upper works from its base.

Marine cranes are usually mounted upon pedestals of relatively small diameter as compared to the reach of the crane boom. A swing circle is mounted at the top of the pedestal, and the crane upper works rides on and revolves around such circle. Thus, the moments of large loads at great reaches must be counteracted and resisted within the restricted confines of the relatively small diameter of the swing circle. Repeated crane overloading or repeated dynamic loading may cause abnormal, momentary peak stresses of such magnitudes that failure may ultimately occur in the swing circle. The present invention seeks to solve this problem by providing a retainer as a part of the swing circle mounting that is passive during normal operation, but which functions to restrain a separation of the crane upper works upon occurrence of an abnormal condition. In its preferred form, there is an arcuate structure fastened on the upper works, at a position opposite the boom, which extends from the rear 90° quadrant of the swing circle. This arcuate structure has a projecting lip that extends beneath and out of contact with an overhanging surface that is a part of the stationary crane base. Secured to the arcuate structure are a plurality of vertical buttresses that extend radially outwardly and upwardly to approach, but not contact, the underside of the crane deck. Thus, if the crane upper works loses its normal stability, such that the upper works beings to separate from the base, the lip of the arcuate structure will engage the overhanging surface to maintain the upper works in place. The buttresses will function to strengthen the arcuate structure, so that resistance to separation is accomplished by a structure that can be confined to within a relatively small space. The height or diameter of the pedestal type base commonly used for marine cranes need not be enlarged to accommodate the invention.

It is an object of the invention to provide a means of limiting the extent of separation of the upper works of a pedestal mounted marine crane from its pedestal during the occurrence of an abnormal condition.

It is another object of the invention to povide an arrangement that does not interfere or affect in any way the normal operations of a marine crane.

It is still another object of the invention to provide an arrangement that can extend around a sufficient portion of a swing circle to limit the separation of the upper works from its pedestal without regard to whether the separation results in forward, rearward, or sideward movement of the upper works in relation to the pedestal.

It is yet another object of the invention to provide an arrangement that is reliable, easy to install and maintain, and which does not add appreciable bulk to the crane structure.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in different embodiments, and reference is made to the claims herein for interpreting the breadth of the invention.

DESCRIPTION OF THE PREFERRED EMBODIMENT

Figure 1:
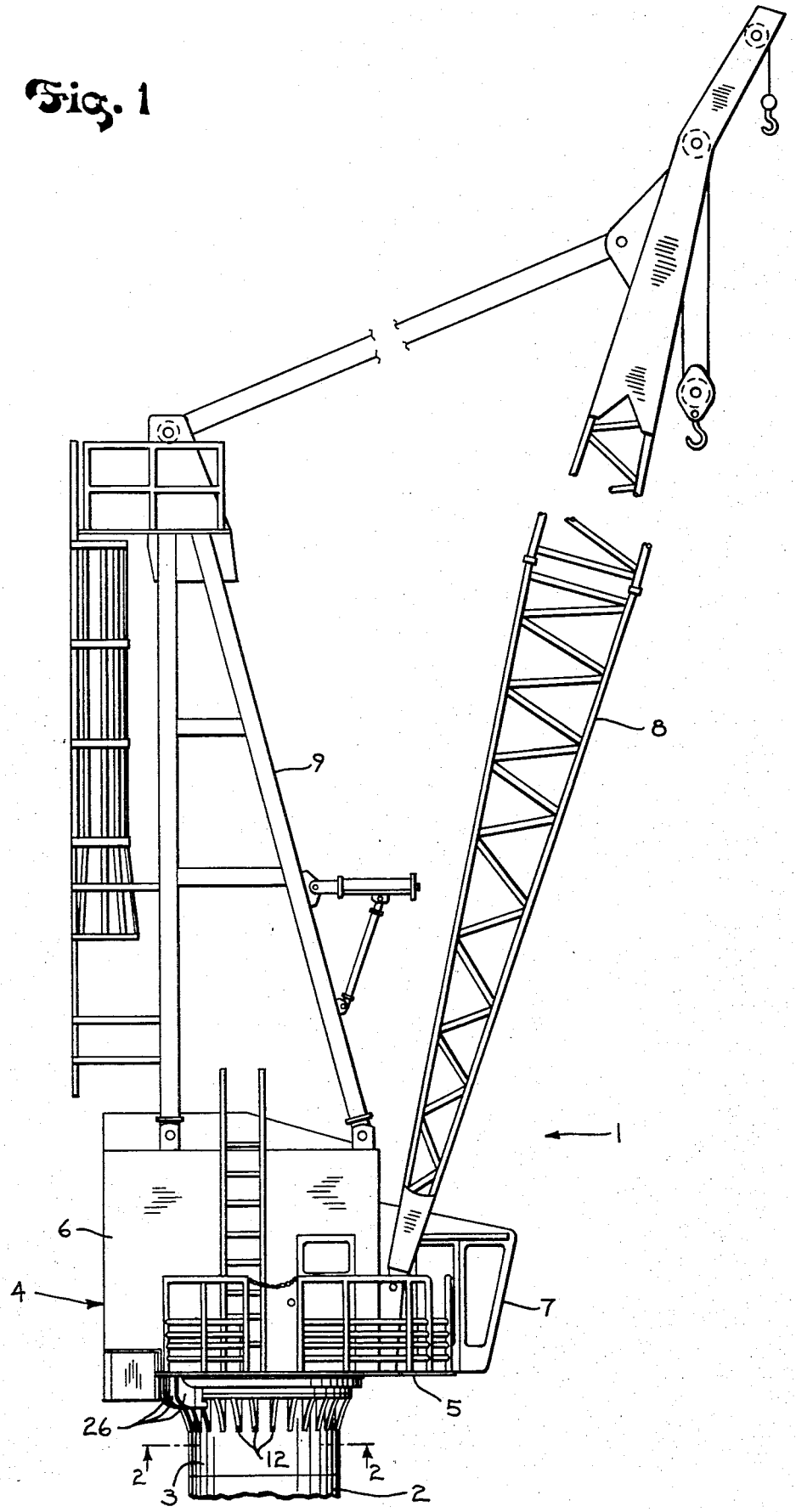
FIG. 1 is a side view in elevation of a marine crane with parts cut away that incorporates the present invention.

Referring to FIG. 1, there is shown a marine crane 1 mounted on a fixed pedestal 2 that may be part of a sea platform, such as used in oil exploration or drilling. The crane 1 has a stationary base in the form of a pedestal adapter 3. The lower end of the adapter 3 is of a circular, cylindrical configuration matching the pedestal 2, and the two parts are welded together to firmly anchor the crane 1 in place. Supported above the pedestal adapter 3 is a crane upper works 4 having a deck 5. A machinery housing 6 covers most of the deck 5 and an operator's cab 7 projects forward from the housing 6. The deck 5 also supports a boom 8 and an A-frame assembly 9 rises from the top of the housing 6.

Figure 2:
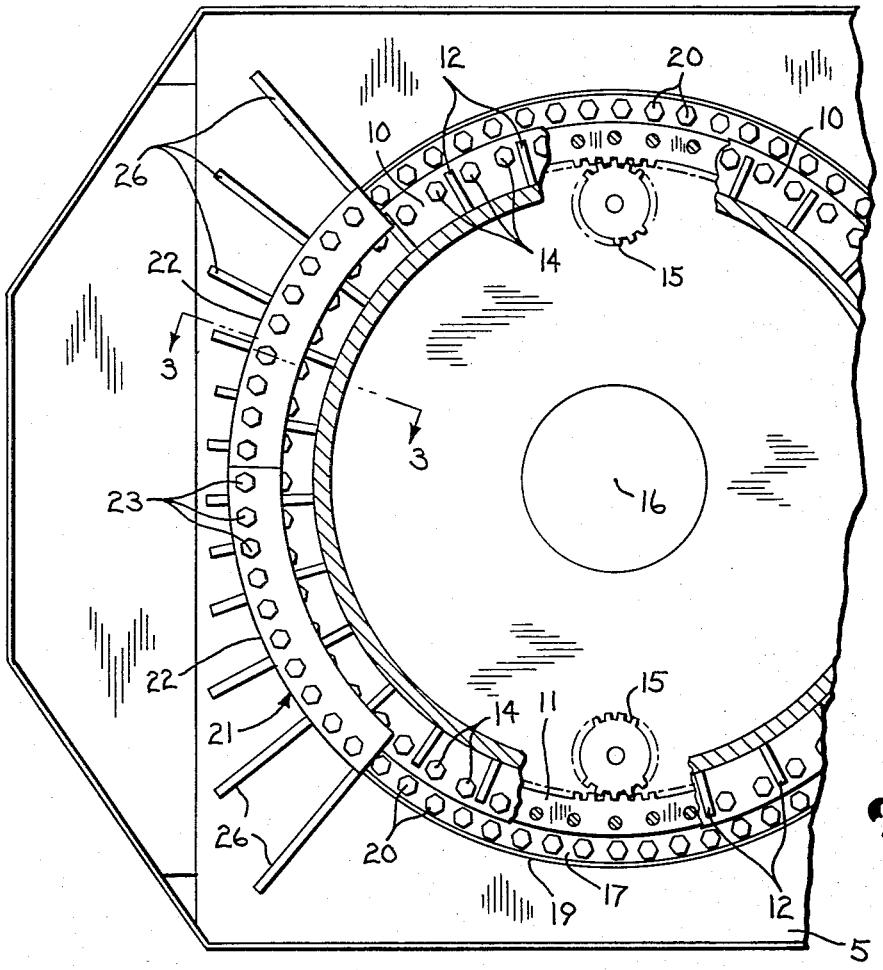
FIG. 2 is a partial bottom view, with parts cut away, taken through the plane 2—2 indicated in FIG. 1.
Figure 3:
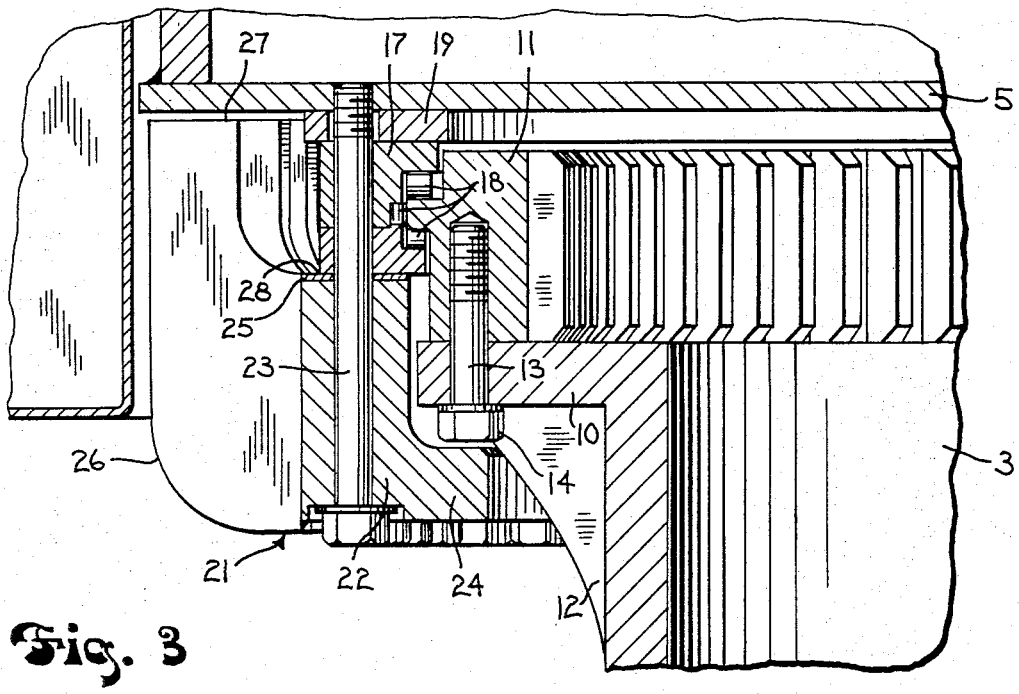
FIG. 3 is a fragmentary view in cross-section taken through the plane 3—3 indicated in FIG. 2.

FIGS. 2 and 3 show the mounting of the upper works deck 5 upon the pedestal adapter 3, the present invention being a part of such mounting. The upper end of the adapter 3 has an overhanging circumferential flange 10 that mounts a stationary inner bearing race 11 of a swing circle assembly. A plurality of vertical gussets 12 are equally spaced from one another circumferentially around the upper end of the pedestal adapter 3 to brace the underside of the flange 10, so that the flange 10 can support the load imposed by the crane upper works 4. To secure the inner race 11 atop the flange 10, a number of closely spaced fastening bolts 13 are inserted upwardly through the race 11, and as seen in FIG. 2 the heads 14 of the bolts 13 present a succession of downwardly facing surface areas that are on the underside of the flange 10.

The inner wall of the stationary race 11 is toothed to present the usual gear track of a swing circle assembly, and as shown in FIG. 2 there are two engine driven pinions 15 depending from the upper works 4 which work against the swing circle teeth to propel the upper works 4 in its circular motion around the swing circle axis 16. In addition to the inner race 11, the swing circle assembly includes a two part outer bearing race 17 and three sets of roller bearings 18 inserted between the races 11 and 17 to complete the swing circle. A large annular ring 19 is welded to the bottom surface of the deck 5 and engages the top surface of the outer race 17.

The upper works 4 is mounted on the swing circle, and a plurality of fastening bolts 20 (the heads of which are shown in FIG. 2) firmly secure the two part outer bearing race 17 and the upper works deck 5 together. The outer race 17 thus rotates with the upper works 4 around the pivot axis 16.

As a means for limiting the extent to which the upper works 4 can be separated from the pedestal adapter 3, in the event of an abnormal condition, a retainer 21 is provided that extends arcuately around a portion of the swing circle assembly. As shown best in FIGS. 2 and 3, the retainer 21 includes a pair of curved segments 22 that are fastened by a plurality of long bolts 23 to a portion of the underside of the outer race 17. The bolts 23 are similar to the bolts 20, except for their longer length to accommodate the retainer segments 22. They are circumferentially spaced similarly as the bolts 20, to continue the bolting together of the outer bearing race 17 and the ring 19 to the deck 5 around the circumference of the swing circle assembly.

The segments 22 form an arc in their longitudinal direction that conforms to the circular shape of the outer race 17, and as seen in cross section in FIG. 3 a lip-like projecting portion 24 of each segment 22 extends radially inward into a position beneath and out of contact with the heads 14 of the fastening bolts 13. These projecting lip portions 24 are normally spaced from the lower surfaces of the bolt heads 14, but are adapted to catch upon the bolt heads 14 to limit separation of the upper works 4 from the crane base, comprising the pedestal adapter 3, in a manner as will hereinafter be described. The distance between the inwardly projecting lip portions 24 of the retainer segments 22 and the bolt heads 14 can be controlled by shims 25 that are inserted between the tops of the segments 22 and the lower face of the outer race 17. This gap can be from about 0.0625 to 0.1875 inches.

As seen in FIG. 3, the retainer segments 22 have a hook-like appearance in cross section, and in the preferred form shown, this hook-like configuration circumferentially encompasses the rear 90° quadrant of the swing circle assembly that is diametrically opposite the boom 8. Each of the two segments 22 encompasses an arc of 45°, and together they provide sufficient circumferential extent to limit the separation of the upper works 4 from the pedestal adapter 3 whenever the upper works 4 begins to tilt forwardly in the direction of the boom 8. However, it should be noted that the retainer segments 22 may encompasss the entire circumference of the swing circle, or some other portion thereof. Also, the hook-like, inwardly projecting lips 24 may be divided into circumferentially spaced segments extending around all or a part of the swing circle assembly.

Welded to the radially outer surface of the hook-like retainer segments 22 are a plurality of vertical plates that form buttresses 26. As seen in FIG. 2, each buttress 26 is positioned in a vertical plane extending radially from the axis of machine rotation 16. The radial extent of the buttresses 26 varies, as space limitations have required, and the general configuration for the buttresses 26 is shown in FIG. 3. From the line of welded attachment to the retainer segments 22, each buttress 26 extend radially outward, and then turns upwardly to terminate in an abutment end 27 that faces the underside of the upper works deck 5.

The buttresses 26 function to brace and resist dislocation of the hook-like retainer segments 22 whenever the segments 22 strike the heads 14 of the fastening bolts 13. In normal operation, the buttresses 26 do not play any function in the machine operation, and it is desirable to have a slight clearance of about 0.02 to 0.03 inches between the buttress abutment ends 27 and the underside of the deck 5, so as not to interfere with flexing of the deck 5 that takes place during normal operation of the crane 1.

The retainer 21 made up of the segments 22 of the buttresses 26 may be assembled as a subassembly by first welding the buttresses 26 to the hook-like segments 22. The retainer 21 is then secured loosely to the bottom of the outer race 17 by the bolts 23. A gap of about 0.0625 to 0.1875 inches is then provided between the projecting lip portions 24 of the hook-like segments 22 and the heads 14 of the fastening bolts 13 by placing shims 25, as needed, between the segments 22 and outer race 17. The completed retainer structure is then tightly secured to the deck 5 and outer race 17 by the bolts 23, and after tightening the bolts 23, the buttresses 26 should also have a clearance of about 0.02 to 0.03 inches between their abutment ends 27 and the underside of the deck 5.

In the event loading of the crane 1 results in an abnormal condition, such as breakage within the swing circle assembly, that may allow the upper works 4 to tip forward and separate from the pedestal adapter 3, the retainer 21 will come into play to effectively limit this separation, as long as the retainer 21 itself is not subjected to such an extreme overload that its segments 22 or the bolts 23 fail. Upon a forward tilting of the upper works 4, there will be an upward movement of the rear of the deck 5. Such a movement of the deck 5 causes the projecting lip portions 24 of the hook-like segments 22 to engage and catch on the heads 14 of the fastening bolts 13. This engagement prevents any further upward movement of deck 5 to arrest tilting of the upper works 4, as long as the strain is within the load limits of the retainer 21 itself. Thus, the upper works 4 is effectively retained on the pedestal adapter 3, upon the occurrence of an abnormal condition.

When the retainer 21 engages the bolt heads 14, the hook-like segments 22 may tend to rotate clockwise, as seen in FIG. 3, by pivoting at their outermost point of contact 28 with the outer race 17. Such rotation tends to bend the heads and shanks of the through bolts 23 clockwise, so that the bolts 23 fail to retain the retainer segments 22 tightly in place against the underside of the outer bearing race 17. If this should occur, then the buttresses 26 come into play to prevent the bolts 23 from being distorted or the segments 22 from rotating clockwise. The abutment ends 27 of the buttresses 26 will engage the underside of the deck 5 as the bolts 23 tend to give or distort. They then resist clockwise rotation (as viewed in FIG. 3) of the segments 22 to maintain the retainer assembly 21 in place, so that the upper works 4 is restrained from tilting. The region of contact between the abutment end 27 of a buttress 26 and the underside of the deck 5 is radially outside the point 28 around which displacement of a segment 22 may occur. The radial distance between the point 28 and this region of contact provides a lever arm, so that the reaction force at the abutment end 27 is effectively multiplied to enhance the resistance to any dislocation of the retainer segment 22. The outward, radial extension of the buttresses 26 thus enhance the strength of the retainer assembly 21. Thus, the greater the lever arm that may be provided between buttresses 26 and the hook-like segments 22, the more effectively the buttresses 26 will resist the rotation of the segments 22.

A retainer 21 has been shown and described that limits the separation of the upper works 4 of a crane 1 from its base. In this structure, the crane base has an overhanging surface which in the drawings comprises the circumferentially arranged bolt heads 14 that extend in a circle around the axis of rotation. Thus, to whatever position the upper works 4 may be rotated, there is an overhanging surface against which the retainer 21 may strike to resist separation of the upper works 4. The retainer 21, in turn, is provided with a substantial arcuate surface that can contact the overhang so that a restraining force can be spread over a substantial area. In addition, radially extending buttresses 26 are provided to give greater strength and stability to the retainer structure. It is apparent, however, that various modifications may be made from the specific structure described. As previously indicated, the retainer 21 may extend completely around the circumference of the crane's swing circle assembly, rather than merely its rear 90° quadrant. Although it is preferred that the hook-like segments 22 be fastened to the rotatable deck 5 of the upper works 4 beneath the outer race 17, they may also be fastened in other positions such as the radially outer surface of the outer rotatable race 17, as well as directly to the deck 5 itself. Also, the overhanging surface areas provided by the bolt heads 14 can take some other form, such as a supplementary flange built around the pedestal adapter 3 or the inner bearing race 11.

It should be noted that under normal operation of the crane 1, the projecting lip portions 24 of the hook-like retainer segments 22 do not engage or rub on the pedestal adapter 3 or any part thereof. Therefore, the retainer 21 does not hinder or interfere in any manner with the normal operation of the crane 1. Also, the retainer 21 may be designed for and used on any size or type of base mounted crane, and may also be adapted for use with other material handling machines.

We claim:

1. In a mounting for a crane having a base and an upper works rotatably supported by the base, the combination of:

a circumferential member on said base that provides overhanging, downwardly facing surface areas that extend circularly about the base;

an arcuate member secured to said upper works positioned concentric with said circumferential member and having an inwardly projecting lip that underhangs said circumferential member at a spaced distance from said downwardly facing surface areas; and a series of buttresses secured to and extending outwardly from said arcuate member, said buttresses including abutment ends facing and spaced from said upper works to form a gap therebetween that prevents the abutment ends from normally engaging the upper works.

2. In a mounting for a crane having a base and an upper works rotatably supported by the base, the combination of:

a circumferential member on said base that provides overhanging, downwardly facing surface areas that extend circularly about the base;

an arcuate member secured to said upper works positioned concentric with said circumferential member and having an inwardly projecting lip that underhangs said circumferential member at a spaced distance from said downwardly facing surface areas;

a series of buttresses secured to and extending outwardly from said arcuate member, said buttresses including abutment ends facing said upper works;

said base includes a pedestal member than has said circumferential member at its upper end, said circumferential member includes a circumferential flange for mounting a swing circle having an inner race and an outer race; and said downwardly facing surface areas are provided by heads of fastening bolts, said bolts extending upwardly through said flange to secure said inner race to said base.

3. The mounting as described in claim 2, wherein:

said outer race is secured to and depending from said upper works; and said arcuate member is secured to said outer race.

4. The mounting as described in claim 1, wherein:

said arcuate member is secured to the rear 90° quadrant of said upper works.

5. In a mounting for a crane having a base that includes a pedestal member that mounts a swing circle for rotating an upper works supported by the base, a retainer comprising:

a circumferential member on said base that provides overhanging, downwardly facing surface areas formed by the heads of fastening bolts, said bolts extending upwardly through said circumferential member to secure said swing circle to said base;

an arcuate member secured to said upper works along the rear 90° quadrant of said swing circle concentric with said circumferential member and having an inwardly projecting lip that underhangs said circumferential member at a spaced distance from said downwardly facing surface areas; and a plurality of buttresses each secured to and extending in a vertical plane radially outward from said arcuate member, said buttresses including abutment ends facing said upper works.

6. The crane mounting as described in claim 5, wherein:

said swing circle has an inner race secured to said pedestal member and an outer race secured to and depending from said upper works; and said arcuate member is secured to and depending from said outer race.

7. In a mounting for a crane having a base that mounts a swing circle for rotating an upper works supported by the base, said swing circle having a first portion mounted on said base and a second portion mounted on said upper works, a retainer comprising:

a circumferential member on said base that provides overhanging, downwardly facing surface areas that extend circularly about the base;

an arcuate member positioned concentric with said circumferential member and having an inwardly projecting lip that underhangs said circumferential member;

fastening means for fastening said arcuate member to the second portion of said swing circle such that said lip underhangs said circumferential member at a spaced distance from said downwardly facing surface areas; and a series of buttresses secured to and extending outwardly from said arcuate member, said buttresses including abutment ends facing and spaced from said upper works to form a gap therebetween that prevents the abutment ends from normally engaging the upper works.

* * * * *